United States Patent [19]

Borst et al.

[11] Patent Number: 4,570,818

[45] Date of Patent: Feb. 18, 1986

[54] RECLOSABLE CONTAINER WITH LABEL BRIDGE

[75] Inventors: Rodney D. Borst, Oregon; Thomas J. Mohs, Madison, both of Wis.

[73] Assignee: Placon Corporation, Madison, Wis.

[21] Appl. No.: 618,561

[22] Filed: Jun. 8, 1984

[51] Int. Cl.[4] ..... B65D 43/14

[52] U.S. Cl. ..... 220/339; 206/459; 229/2.5 R; 229/44 R; D9/426

[58] Field of Search ..... 229/2.5, 43, 44 R; 206/459; 220/339, 337; D9/420–426

[56] References Cited

U.S. PATENT DOCUMENTS

| | | | |
|---|---|---|---|
| D. 165,219 | 11/1951 | Degner | 206/549 X |
| D. 258,268 | 2/1981 | Axel | D9/426 |
| 1,695,286 | 12/1928 | Johnson | 220/257 |
| 2,138,241 | 11/1938 | Koch et al. | 206/491 |
| 2,202,279 | 5/1940 | Wilson | 229/44 CB |
| 2,544,975 | 3/1951 | Berger | 206/44 R |
| 2,885,135 | 5/1959 | Friday | 229/2.5 R |
| 3,043,354 | 7/1962 | Fitzgerald | 229/2.5 R |
| 3,082,903 | 3/1963 | Stevens et al. | 220/339 |
| 3,344,974 | 10/1967 | Bostrom | 229/43 |
| 3,397,774 | 8/1968 | Tjaden | 220/352 X |
| 3,580,485 | 5/1971 | Hall | 229/43 |
| 3,670,952 | 6/1972 | Venuti et al. | 229/44 R |
| 3,902,540 | 9/1975 | Commisso | 229/2.5 R X |
| 3,942,707 | 3/1976 | Schidlowski et al. | 229/2.5 R |
| 3,955,710 | 5/1976 | Commisso | 229/2.5 R X |
| 4,096,986 | 6/1978 | Florian | 229/44 R |
| 4,202,464 | 5/1980 | Mohs et al. | 220/339 |
| 4,312,451 | 1/1982 | Forbes, Jr. | 229/44 R X |

FOREIGN PATENT DOCUMENTS

| | | | |
|---|---|---|---|
| 879186 | 10/1961 | United Kingdom | 229/2.5 R |

*Primary Examiner*—Allan N. Shoap
*Assistant Examiner*—Bryon Gehman
*Attorney, Agent, or Firm*—Isaksen, Lathrop, Esch, Hart & Clark

[57] ABSTRACT

A reclosable container formed from thin, flexible thermoformed plastic material. The container has a base and a domed lid joined together by an integral hinge. The relatively flexible container base is stiffened and made rigid only when the lid is inserted into the container base. The lid and the engaged base are strengthened by rims which are provided about the periphery of the lid. Portions of the lid are flared to engage the sides of the base. When the container is closed, the base and the flared portions of the lid provide an essentially non-protruding and smooth label bridge to which a label may be applied without creating a significant gap between the label and the closed container.

21 Claims, 4 Drawing Figures

Fig 3
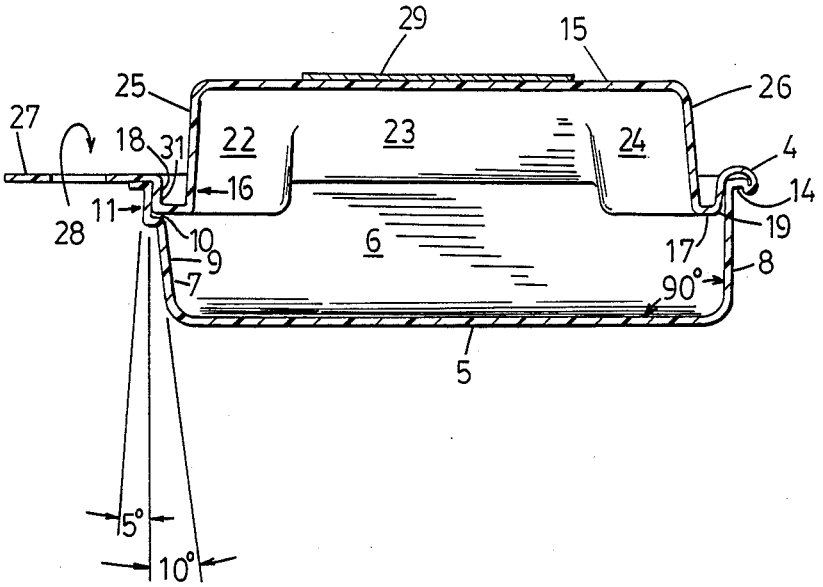
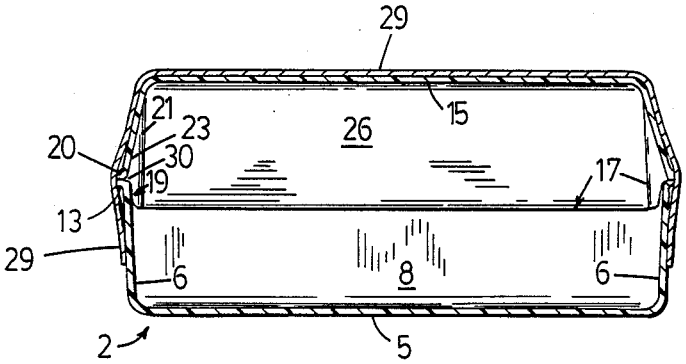
Fig 4

RECLOSABLE CONTAINER WITH LABEL BRIDGE

TECHNICAL FIELD

The present invention relates to containers in general, and in particular, to thermoformed plastic containers for use in the retail display of small merchandise and for the storing of loose articles such as fishing lures, cabinet hinges, electrical fuses and the like.

BACKGROUND OF THE INVENTION

The use of plastic thermoformed materials for reclosable containers is generally known. One such container is disclosed in U.S. Pat. No. 4,202,464, which discloses a reclosable container particularly adapted for a retail display and for receiving a label over the exterior of the reclosable container.

Thermoformed plastic containers are particularly desirable for small article packaging because they are both thin and resilient. Generally such containers are molded from a sheet of plastic of uniform thickness, and they typically have an overhang or flange at the parting line of the lid and the base as shown in U.S. Pat. No. 3,397,774. Containers constructed in accordance with the disclosure of U.S. Pat. No. 4,202,464 are devoid of such flanges on the sides thereof without effective loss of structural stability. Such containers have been found to be particularly advantageous for retail display use because they can receive labels which closely conform to the outer surfaces of the containers without substantial gaps between the containers and the labels. These containers have been well suited for small articles such as bolts, nuts, paper clips, screws and the like where it is desired that the base of the container extend for substantially the full height thereof, so that the small articles will be fully retained in the container base when the lid is opened for article access. However, when packaging individual or small numbers of articles of somewhat larger size, such as fishing lures, cabinet hinges, spark plugs or the like, it is advantageous to use containers which have a domed lid wherein a substantial portion of the depth of the container can be formed into the lid as well as the base of the container. Where a given box depth can be shared between the lid and the base, the cost of the package will be reduced because it is possible to use a thinner plastic sheet stock in the thermoforming process. Neither the container of U.S. Pat. No. 4,202,464 nor other known prior art thermoformed containers are adaptable for domed lid construction while at the same time presenting side wall surfaces which will receive labels in close conformity without unsuitable gaps between the side walls and the labels.

SUMMARY OF THE INVENTION

The present invention is summarized in that a reclosable container formed of thin, flexible thermoformed plastic material includes: a container base with walls; a removable lid with walls, the lid serving as a top portion for both closing and strengthening the container base; a rim formed about much of the periphery of the lid, the rim being shaped so that its outer wall is engaged by the top inner edge of the container base when the container is closed; and at least one label bridge formed by flaring a portion of a lid wall so that the bridge overlies a container base wall without substantial overhang when the lid is closed upon the base.

It is a principal object of the present invention to provide a reclosable container formed of thin, flexible thermoformed plastic material which may have a domed lid and which is capable of receiving a closely conforming label over the lid and at least one portion of the base walls without a substantial gap between the container and the label at which the label may be easily severed.

It is a further object of the present invention to provide a domed lid container with substantially flush fitting side walls which are adapted to receive a label in closely conforming relation such that the label retains the container in closed position and provides a tamper evident seal for the container.

It is a further object of the present invention to provide a domed container design which can be economically produced by utilizing a thinner gauge plastic than that utilized for a flat lidded container having the same circumference and volume.

Other objects, advantages, and features of the present invention will become apparent from the following specification when taking in conjunction with the accompanying drawings.

BRIEF DESCRIPTION OF THE DRAWINGS

The accompanying drawings illustrate the best mode presently contemplated by the inventors for carrying out the invention.

In the drawings:

FIG. 3 is a longitudinal section view taken along section line 3—3 of FIG. 2.

FIG. 4 is a transverse section view taken along section line 4—4 of FIG. 2.

DESCRIPTION OF THE PREFERRED EMBODIMENT

The reclosable container, according to the present invention, is an improvement upon the reclosable container disclosed and claimed in U.S. Pat. No. 4,202,464, to Mohs and Engel.

Figure 1:
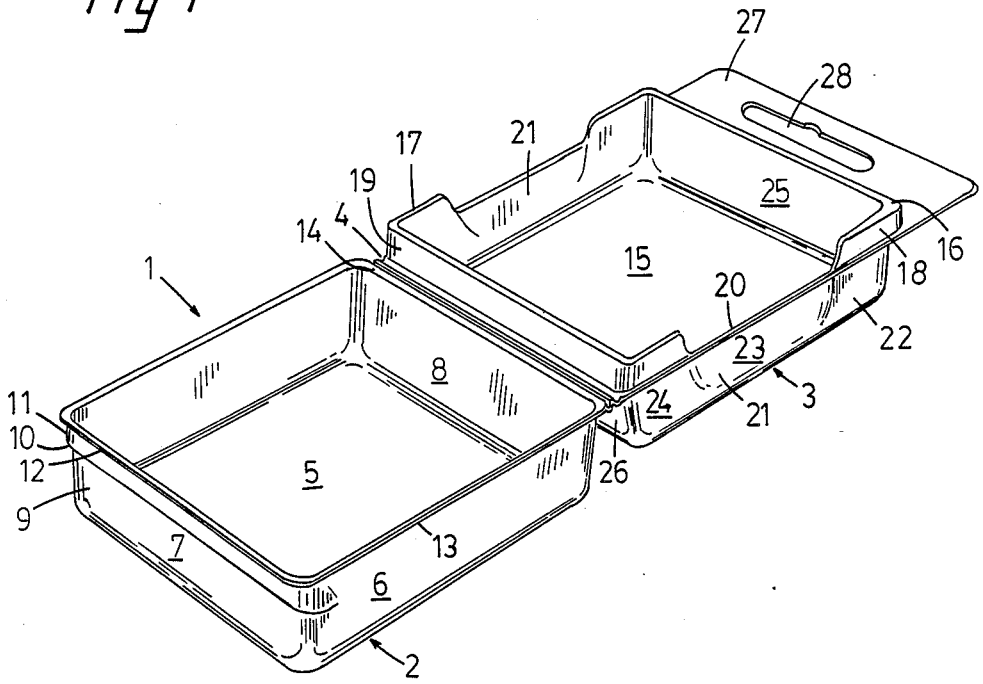
FIG. 1 is a perspective view of a reclosable container constructed in accordance with the invention, with the lid integrally hinged to the base and shown in the open position.
Figure 2:
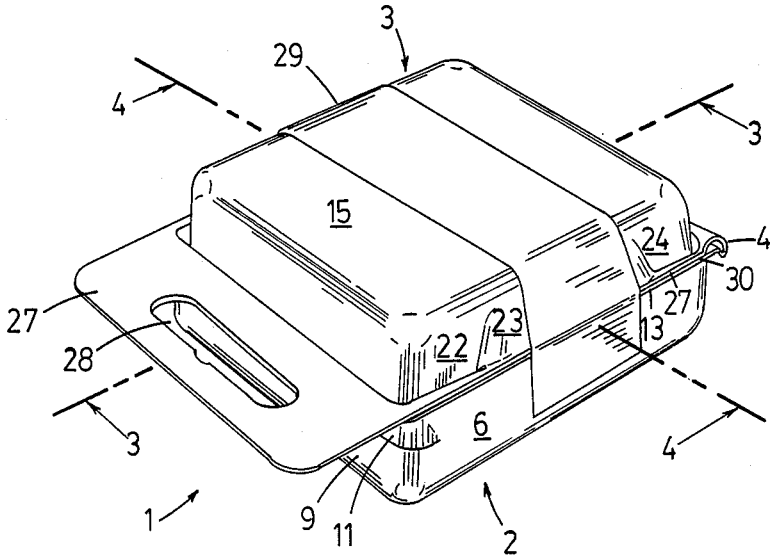
FIG. 2 is a perspective view of the container when closed and sealed with a label.

Shown in the drawings is an improved reclosable container 1 having a base 2 and a domed lid 3. In this embodiment the lid defines a substantial portion of the volume of the closed container. As shown in FIG. 1 and FIG. 2, the container 1 includes a container base 2 and a domed lid 3 which are joined together by a hinge 4 integrally formed with both the container base 2 and the lid 3. The container 1 is preferably constructed of thermoformed, clear plastic having flexible walls of relative thinness, i.e., approximately in the range of 0.01 to 0.03 inches thick.

The container base 2 includes a generally rectangular flat bottom portion 5 and a pair of upstanding planar side walls 6. The side walls 6 are joined at their front and rear by front and rear upstanding end walls 7 and 8, respectively. The rear wall 8 is shown generally perpendicular to the flat bottom 5, while the side walls 6 are angled outward approximately 5° from perpendicular with respect to the flat bottom portion 5 as seen in FIG. 3. The front end wall 7 includes a lower portion 9 which is angled outward approximately 10° from perpendicular with respect to the flat bottom 5, an upper portion 11 which is angled inward approximately 5° from perpendicular with respect to the flat bottom 5, and a horizontal shelf 10 between the lower and upper portions, 9 and 11, respectively. Alternatively, all base walls 6, 8 and 9 may be angled outward approximately 3° to 5° to provide the necessary draft angles to assure easy mold release and desirable nesting capabilities as discussed more fully below. An outwardly oriented, horizontal flange 12 is provided at the top margin of the upper front end wall portion 11. The rim portion or top margin 13 of each of the side walls 6 is preferably terminated in the plane of the side wall or alternatively may have an outwardly oriented extremely narrow bead-like lip so long as there is no substantial outward protrusion of the lip. A flange 14, similar to flange 12, extends along the top margin of the rear wall 8 and merges int the hinge 4. Flanges 12 and 14, and margin 13 define a continuous flat planar edge at the top of the container base 2.

The domed lid 3 includes a generally rectangular flat top portion 15 and a pair of side walls 21, each side wall having a front section 22, a center section 23, and a rear section 24. The side walls 21 are joined at their front and rear by front and rear end walls 25 and 26 respectively. The lid thus defines a substantial portion of the depth and volume of the closed container for most economic utilization of material in the thermoforming process. The end walls 25 and 26 as well as the front and rear sections 22 and 24 of the side walls, respectively, are angled outward approximately 5° from the perpendicular with respect to the flat top portion 15 and terminate with a generally U-shaped outward bend, thereby forming a front rim 16 which overlaps lid wall portions 25 and 22, and a rear rim 17 which overlaps lid wall portions 24 and 26. The rims 16 and 17 have outer walls 18 and 19, respectively, which are received snugly just inside the top margins of end walls 7 and 8 and side walls 6 of the container base 2 when the lid 3 is in the closed position shown in FIG. 2. These rims provide lateral strength for both the base walls 6, 7 and 8 and lid walls 21, 25 and 26 of the container when it is in a closed condition. The rear end portion of the outer wall of the rear rim 19 merges directly into hinge 4. Hinge 4 extends substantially across the width of the container 1. The front end portion of the outer wall 18 of the front rim 16 is provided with a reverse taper as at 31 in FIG. 3 which complements and mates with the similarly tapered wall portion 11 of base 2. Thus, as best seen in FIG. 3, when lid 3 engages base 2 as the container is closed, a snap-type locking action occurs to assist in holding the lid in place. This releasable lock feature is important for it allows continued and repeated use of the container after it is unsealed.

The center sections 23 of the lid side walls 21 are flared outwardly in a novel manner from the flat top portion 15 and the adjacent end sections 22 and 24 such that when the container is closed, the bottom margins of the lid side wall center sections 23 engage the top margins of the respective base side walls 6 in abutting relation, without substantial overhang. The lid side wall center sections 23 and abutting base side walls 6 thus co-operate to form a substantially continuous label bridge on each side of the container, as shown in FIG. 2 and FIG. 4.

As shown in FIG. 1, a flange 27 is provided about the periphery of the rim wall 18 and side portions of rim wall 19. The rim or bottom margin 20 of each of the lid side wall center sections 23 is preferably terminated in the plane of the center section, or alternatively may have an outwardly oriented extremely narrow bead-like lip so long as there is no substantial outward protrusion of the lip. The flange 27 is extended at the lid front to form a pull tab provided with a hole 28 by which the container may be hung in display. The flanges 27 and margin 20 define a flat planar edge around the front and sides of the container lid 3 which, when the container is closed, engages the aforementioned planar edge defined by the flanges 12 and 14 and margins 13 of the container base 2. The narrowness of margins 13 and 20 is such that the sides of the closed container are substantially smooth and non-protruding at the label bridge when the container is in the closed position.

When the container is filled with one or more articles for packaging and display, an adhesive label 29 is normally placed on the container to provide a tamper evident seal for the container. The label will normally be imprinted with descriptive information about the articles packaged within the container. As shown in FIG. 2, the label 29 is placed over the lid 3 and extended smoothly over the center section 23 of the lid side wall 21 and onto a portion of the base side wall 6 in closely adhering relation. The label 29 thus structurally combines with the container side walls to integrally retain the container in a closed condition. the label 29 covers only a portion of lid 3 with the remainder of the transparent lid providing a viewing area which allows prospective purchasers to see the merchandise within the container. The provision for such a viewing area is also quite desirable during use by the purchaser, who can readily identify the contents of the closed container by viewing through the domed lid.

The label 29 can be seen in FIG. 4 to adhere closely to the top portion 15 of lid 3, the center section 23 of the lid side wall 21, the abutting edges provided by the junctures 30 of margins 20 and 13 and side walls 6 of the base 2 without any substantial gaps between the label and the container. Accordingly, when the label 29 is stretched tightly over the container and adhered thereto it is substantially continuously underlain by the container and presents no significant unsupported spans which might easily be broken. In that the junctures 30 and the side walls 23 and 6 define a substantially non-protruding surface, the label 29 provides a highly desirable unitary seal with an attractive appearance which is not prone to accidental tearing or fatigue. Accordingly, it can be seen that the margins 13 and 20 of the base side walls 6 and lid side wall center section 23, respectively, should not protrude outwardly beyond the planes of the walls and center section such that a flange would be formed which would displace the label outwardly from the side walls and center section a sufficient distance to form a significant gap when the label is wrapped tangentially around the container.

Frequently, in use the lid 3 may be treated as the lower half of the hinged container, with the base 2 being treated as the cover. In such applications, the label 29 will be reversed, stretching across the base bottom 5, the base side walls 6, the abutting edges of margins 13 and 20, and the center sections 23 of lid side walls 21, terminating on the center sections near the top portion 15 of lid 3.

As mentioned above, the base walls 6 and 7 are angled outward from the base bottom portion 5. This results in the perimeter of the edge defined by flanges 12 and 14, and margin 13 of the container base 2 being larger than the perimeter of the base bottom portion 5.

Similarly, the lid walls 21, 25 and 26 are angled outward from the lid top portion 15, such that the inside lid perimeter increases away from the top portion 15. Consequently, when the containers are in the open condition as in FIG. 1, they may be nested by inserting the bottom portion 5 and the top portion 15 of one container within the respective base and lid of another container. This nesting of empty containers is an important feature because a large number of unfilled containers such as 1 can be economically stored and shipped. Furthermore, stacked containers can be readily loaded into automatic denesting apparatus which forms a part of modern automated packaging lines.

It is to be understood that the present invention is not limited to the particular construction and arrangement of parts disclosed herein, but embraces all such modified forms thereof as may come within the scope of the following claims.

We claim:

1. A reclosable container of thin flexible thermoformed plastic materials, comprising:

(a) a container base having a bottom portion;

(b) base walls extending from the periphery of the base bottom portion in continuous joined relation upwardly to a rim portion (c) a container lid defining a substantial portion of the volume of the container and having a top wall portion;

(d) lid walls extending from the periphery of the lid top portion in continuous joined relation;

(e) a peripheral lid rim including first and second rim portions;

(f) said first rim portion of the lid walls terminating in a generally U-shaped outward bend which overlaps an interior portion of said base walls adjacent said rim portion of the base walls when the container is closed, the first rim portion having outer walls which are shaped to closely conform to and be snugly received inside the base walls when the container is closed to strengthen the container;

(g) said second lid rim portion interrupting the first lid rim portion said second lid rim portion being flared outwardly from the lid top wall portion and the lid first rim portion, the second lid rim portion terminating closer to the top wall portion of the lid than the first lid rim portion to substantially abut a portion of the base walls when the container is closed, the abutting portions of the lid walls and base walls cooperating to form a substantially continuous label bridge over which a label may be substantially smoothly applied and substantially continuously underlain and supported by the closed container; and (h) an integral hinge joining the base to the lid such that the container may be opened or closed in hinged relation.

2. The container of claim 1 wherein the upper margins of the base walls define a planar base edge, the margins of the rim outer walls and the margin of the flared portion of the lid walls define a planar lid edge, and the lid edge engages the base edge when the container is closed.

3. The container of claim 2 wherein the container base bottom portion is generally flat and is approximately parallel to the plane defined by the base edge; and wherein the lid top portion is generally flat and approximately parallel to the plane defined by the lid edge.

4. The container of claim 1 wherein the abutting portions of the base walls and the lid walls have narrow bead-like lips at their abutting margins which do not substantially protrude from the walls.

5. The container of claim 1 wherein the lid has a flange extending from the rim wall at the front of the lid, the flange having a hole which may be used to hang the container.

6. The container of claim 1 wherein the container base bottom portion is generally rectangular and the base walls comprise a pair of generally planar side walls, a generally planar front end wall joining the side wall ends remote from the hinge, and a generally planar rear end wall joining the side wall ends near the hinge, and wherein the container lid top wall portion is generally rectangular and the lid walls comprise a pair of side walls, a front end wall joining the side wall ends remote from the hinge, and a rear end wall joining the side wall ends near the hinge, all of which walls are generally planar except for the outwardly flared portion of the lid walls.

7. The container of claim 6 wherein the outwardly flared portion of the lid walls includes an outwardly flared portion located at the center of each lid side wall.

8. The container of claim 6 wherein the base front end wall includes a lower wall portion tapered upwardly and outwardly, an upper wall portion of reverse taper and a shelf between and joining said lower and upper wall portions; and wherein the outer wall of the lid rim extends outwardly where it engages the base front end wall so as to releasably engage the reverse taper of the upper wall portion of said front base end wall to form a releasable lock for the container when the lid is closed.

9. The container of claim 8 wherein the taper of the lower wall portion is about 15° from the plane of the reverse taper of the upper wall portion.

10. The container of claim 1 wherein the base walls and the lid walls are all angularly oriented in an outward direction for removably nesting the container within another container constructed in a like manner.

11. The container of claim 1 wherein the thermoformed plastic material is relatively clear such that items within the container may be viewed through the plastic material.

12. In a reclosable container of thin flexible unitary thermoformed plastic material having a rectangular base with a rectangular flat bottom portion and generally planar side walls and front and rear end walls which join said side walls, all of the base walls terminating at a base edge which defines a flat plane parallel to the flat bottom, and the container also having a rectangular lid with a rectangular flat top wall portion, a pair of side walls and front and rear end walls which join said side walls, the lid defining a substantial portion of the volume of the container and being joined at its rear to the rear of the base by an integral hinge such that the container may be opened and closed, wherein the improvement comprises:

(a) a generally U-shaped outward bend depending from the lid front end wall, lid rear end wall and first portions of each lid side wall to form peripheral lid rim portions which overlap adjacent base front end wall, base rear end wall and base side wall portions, the lid rim portions having outer walls which are shaped to closely conform to and be snugly received inside the base walls when the container is closed; and (b) a second portion of each lid side wall interrupting opposing parts of the first portions of the respective lid side wall and being flared outwardly from the lid top portion and the adjacent first lid portions, the second lid rim portions terminating closer to the top wall portion of the lid than the rim portions to substantially abut a portion of the base side walls when the container is closed, the abutting portions of the lid side walls and the base side walls cooperating to define two substantially continuous label bridges over which a label may be substantially smoothly applied and substantially continuously underlain and supported by the closed container.

13. The container of claim 12 wherein the abutting portion of the base side walls and the lid side walls have narrow bead-like lips at their abutting margins which do not substantially protrude from the walls.

14. The container of claim 12 wherein the lid has a flange extending from the rim wall at the front of the lid, the flange having a hole which may be used to hang the container.

15. The container of claim 12 wherein the base front end wall includes a lower wall portion tapered upwardly and outwardly, an upper wall portion of reverse taper and a shelf between and adjoining the lower and upper wall portions; and wherein the outer wall of the lid rim extends outwardly where it engages the base front end wall to releasably engage the reverse taper of the upper wall portion of the front base end wall to form a releasable lock for the container when the lid is closed.

16. The container of claim 15 wherein the taper of lower wall portion is about 10° from the plane normal to the bottom portion, and the reverse taper of the upper wall portion is about 5° from the plane normal to the bottom portion.

17. The container of claim 12 wherein the base walls and the lid walls are all angularly oriented in an outward direction for removably nesting the container within another container constructed in a like manner.

18. A reclosable container of thin flexible thermoformed plastic materials, comprising:

(a) a container base having a bottom portion;

(b) base walls extending from the periphery of the base bottom portion in continuous joined relation upwardly to a rim portion;

(c) a container lid defining a substantial portion of the volume of the container and having a top wall portion;

(d) lid walls extending from the periphery of the lid top portion in continuous joined relation;

(e) a peripheral lid rim including first and second rim portions;

(f) said first rim portion of the lid walls which terminates in a generally U-shaped outward bend which overlaps an interior portion of said base walls adjacent said rim portion of the base walls the container is closed, the first rim portion having outer walls which are shaped to closely conform to and be snugly received inside the base walls when the container is closed to strengthen the container;

(g) said second lid rim portion of the lid walls interrupting the first lid rim portion, said second lid rim portion being flared outwardly from the lid top wall portion and the lid first rim portion, the second lid rim portion terminating closer to the top wall portion of the lid than the first lid rim portion to substantially abut a portion of the base walls when the container is closed, the abutting portions of the lid walls and base walls cooperating to form a substantially continuous label bridge having a substantially non-protruding surface; and (h) an adhesive label smoothly applied over the label bridge and substantially continuously underlain and supported thereby to seal the container in closed position.

19. The container of claim 18 wherein the label is no wider than the flared second rim portion of the lid walls.

20. The container of claim 18 further comprising an integral hinge joining the base to the lid such that the container may be opened and closed in hinged relation.

21. The container of claim 20 wherein the bottom portion is generally rectangular and flat; the base walls comprise a pair of generally planar side walls, a generally planar front end wall joining the side wall ends remote from the hinge, and a generally planar rear end wall joining the side wall ends near the hinge, the upper margins of the base walls defining a planar base edge parallel to the flat bottom; the top portion is rectangular and flat; the lid walls comprise a pair of side walls, a front end wall joining the side wall ends remote from the hinge, and a rear end wall joining the side wall ends near to the hinge, all of which lid walls are generally planar except for two outwardly flared lid wall portions positioned directly opposite to each other, one on each lid side wall; the outer margins of the flared lid wall portions and the margins of the lid rim outer walls define a planar lid edge parallel to the flat top which meets with the base edge when the container is closed; and wherein the label is no wider than the flared lid wall portions and is long enough to span the width of the top portion, the two flared lid wall portions and a portion of the two base side walls when the container is closed thereby sealing the container in its closed position at two locations without a significant gap between the label and the container.

* * * * *

UNITED STATES PATENT AND TRADEMARK OFFICE

CERTIFICATE OF CORRECTION

PATENT NO. : 4,570,818

DATED : February 18, 1986

INVENTOR(S) : Rodney D. Borst; Thomas J. Mohs

It is certified that error appears in the above-identified patent and that said Letters Patent are hereby corrected as shown below:

In the description of the preferred embodiment, column 3, line 16, "int" should read --into--.

In the claims, in Claim 18, column 8, line 4, before "the container" insert --when--.

Signed and Sealed this

*Twenty-seventh* Day of *May 1986*

[SEAL]

*Attest:*

DONALD J. QUIGG

*Attesting Officer*

*Commissioner of Patents and Trademarks*